United States Patent [19]

Swanson et al.

[11] 4,273,142

[45] Jun. 16, 1981

[54] SMOKING FILTERS

[75] Inventors: Gerald T. Swanson; John Trenary, both of Ft. Collins, Colo.

[73] Assignee: Teledyne Industries, Inc., Ft. Collins, Colo.

[21] Appl. No.: 58,083

[22] Filed: Jul. 16, 1979

[51] Int. Cl.[3] ..... A24D 3/00; A24F 7/04

[52] U.S. Cl. ..... 131/339

[58] Field of Search ..... 131/187, 198 R, 198 A, 131/200, 201, 261 B, 261 R, 207, 210, 10 R, 10 A, 10.5, 261 A, 216, 170 R

[56] References Cited

U.S. PATENT DOCUMENTS

| | | | |
|---|---|---|---|
| 1,508,053 | 9/1924 | Hicks | 131/178 |
| 3,504,677 | 4/1970 | Doppelt | 131/10 A |
| 3,603,319 | 9/1971 | Badgett | 131/261 A X |
| 3,791,265 | 2/1974 | Westcott | 131/261 R |

FOREIGN PATENT DOCUMENTS

| | | | |
|---|---|---|---|
| 234188 | 12/1944 | Switzerland | 131/261 B |

*Primary Examiner*—Stephen C. Pellegrino
*Attorney, Agent, or Firm*—Hugh H. Drake

[57] ABSTRACT

A filter for cigarettes or the like has an elongated tubular shell one interior end portion of which may be shaped to define a seat of a diameter to frictionally receive an end portion of a cigarette and longitudinally of that seat being shaped to define a tubular wall of predetermined cross-section and partially closed by a transverse wall in which is defined a central aperture. An air inlet extends through the outer wall of the shell. A filter element is of a porous material which is inhibitive to the passage of substances such as tar and nicotine. The element is in the form of an elongated hollow sleeve one end of which is closed and the other end of which is open. A laterally projecting shoulder is defined on the sleeve to have the aforementioned predetermined cross-section so as to seat frictionally within the tubular wall and against the transverse wall with a portion of the sleeve projecting through the aperture.

28 Claims, 9 Drawing Figures

SMOKING FILTERS

The present invention pertains to smoking filters. More particularly, it relates to entire filter combinations and assemblies as well as to filter elements.

It has long been recognized that the smoking of cigarettes may have an adverse affect upon the health of the user. It often has been stated that certain matter within the cigarette smoke is undesirably inhaled into the human system. Over many years, a large variety of filters have been suggested for processing this smoke prior to inhalation and thereby removing or trapping undesired matter.

Usually, such filters either interpose a finely-meshed material in the path of the smoke or create a tortuous route for the passage of the smoke so as to cause the settling out of particulate matter on surfaces presented within the filter. A recent novel implementation of the latter approach is the disclosure in U.S. patent application Ser. No. 828,505, filed Aug. 29, 1977. Other references pertinent to that latter approach are listed in that patent application. The former approach, which involves using porosity of a filter medium, is represented by such prior art as U.S. Pat. Nos. 2,954,772 and 3,713,452 and Canadian Pat. No. 948,514, as well as other commercially available filter elements which include some kind of porous material, often fibrous, interposed into the path of flow of the smoke from the cigarette to the user.

In several prior approaches, it has been suggested that a quantity of air should be admitted into the smoke passage so as to dilute the concentration of the smoke ultimately inhaled. One difficulty with that approach is that the user may experience an undesirable reduction in the amount of draw resistance or drag.

Prior filters which have approached the desired result by interposing a porous medium in the flow path of the smoke have even included a feature of initially being of a light color and subject to being darker in color as particulate matter is collected within the filter. Of course, that may provide a visual indication to the user of need for replacement of the filter. In addition, the user often has been given a similar indication by reason of increased draw resistance through the filter as particulate matter is entrapped therein.

For the person who desires to continue to smoke cigarettes notwithstanding their possible danger, one problem he encounters with the use of filtering elements is that at least a large portion of the taste he desires is removed by the filtering element. It has been suggested to counteract that effect by introducing a flavoring medium, such as chocolate, into the tobacco itself. Another disadvantage of any of the filters mentioned above is that, as they do their job, they tend to retain a smell which is offensive at least to other persons associated with the user. All considered, the tortuous-path approaches as described above do not readily admit to low-cost implementation of flavoring or deodorizing of the filter apparatus, while the porous filter type of approach at least often has resulted in an undesirably increased cost in connection with the manufacture and provision of such filters.

It is, accordingly, a very general object of the present invention to provide a new and improved filter apparatus which accommodates the more positive aspects of the foregoing approaches while at the same time avoiding their deficiencies.

Another object of the present invention is to provide a new and improved approach both as to the design of filter assemblies as well as to the formation of the basic filter element itself.

A related object of the present invention is to provide a new and improved basic filter element which may be utilized in a variety of apparatus including that designed not only for cigarette smoking but also accommodating usage in other smoking paraphernalia such as pipes.

Consistent with all of the foregoing is a further objective of providing filtering of the smoke by use of apparatus economical of manufacture and distribution for the purpose of enhancing the use thereof for the ultimate benefit of the users.

The invention as embodied overall in a smoking filter combination has an elongated tubular shell one interior end portion of which is shaped to define a coupling to a smoking device, and longitudinally of that coupling there is defined a tubular wall of predetermined cross-section that is partially closed by a transverse wall in which is defined a central aperture. In its overall combination, an air inlet is defined through the outer wall of the shell. A filter element, of a material porous to smoke but inhibitive to the passage of undesired substances, is in the form of an elongated hollow sleeve one end of which is closed and the other of which is open. On the exterior of that sleeve is defined a laterally projecting shoulder of a cross section so as to seat within the tubular wall and against the transverse wall with a portion of the sleeve projecting through the aperture. The invention also is addressed to the filter element itself, regardless of the particular structure of that which defines the ultimate smoke passage. While the invention is particularly directed to usage with regard to cigarette smoke, it also is useful with regard to other means of smoking tobacco as well as to the smoke produced by other substances.

The features of the present invention which are believed to be potentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
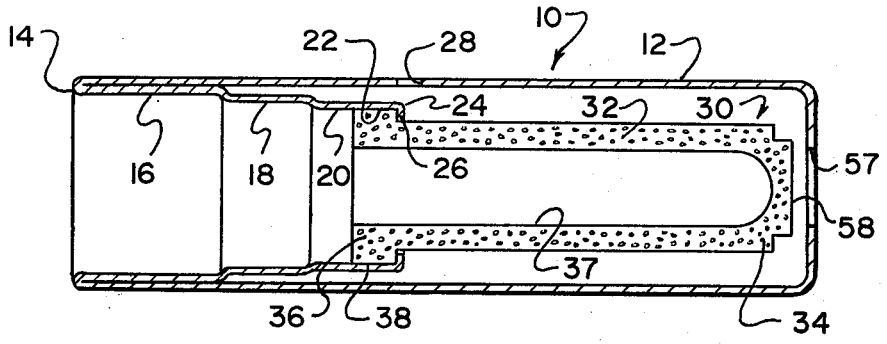
FIG. 1 is a longitudinal cross-sectional view of a cigarette filter constructed in accordance with the present invention.

Various aspects of the subject matter to be discussed have aspects clearly applicable to the filtering of smoke produced by the burning or other degeneration of various matter and to the separation of undesired substances from such smoke regardless of particular type. Also, the approach is adaptable to the filtering of smoke produced by various devices other than cigarettes, such as cigars and pipes. Nevertheless, the specific embodiment will be described in terms of cigarettes and the smoking of the same.

As embodied in FIGS. 1–5, an overall smoking filter 10 includes an elongated tubular shell 12 one end 14 of which is turned re-entrantly inward and shaped interiorly to define a successive series of progressively-lesser-diameter couplings or seats 16, 18 and 20, each of a diameter to frictionally receive an end portion of a cigarette. Of course, the differences in the diameters of seats 16–20 accommodate respectively different standard cigarette sizes as may be on the market. Seat 20 extends on inwardly to define a tubular wall 22 of predetermined cylindrical cross-section and which is partially closed at its inner end by a transverse wall 24 in which is defined a central aperture 26. An air inlet 28 extends through the outer wall of shell 12.

A filter element 30, of a material porous to cigarette smoke but inhibitive to the passage of substances such as tar and nicotine, is in the form of an elongated hollow sleeve 32 one end 34 of which is closed and the other end 36 of which is open to define a bore 37. Defined on the exterior of sleeve 32, so as to encircle open end 36, is a laterally projecting shoulder 38 having the same cross section as described above so as to seat frictionally within tubular wall 22 and against transverse wall 24 with most of sleeve 32 projecting through and on beyond aperture 26.

Figure 6:
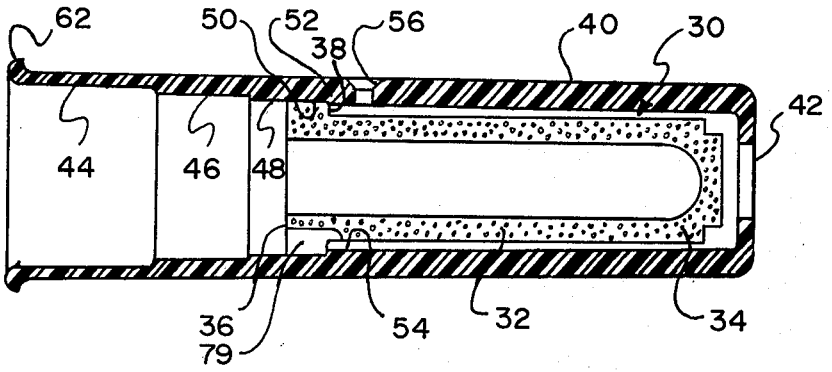
FIG. 6 is a longitudinal cross-sectional view of an alternative to the overall assembly of FIG. 1.
Figure 7:
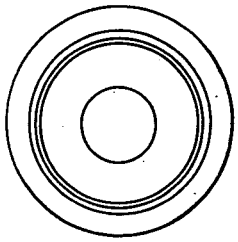
FIG. 7 is an end elevational view taken from the left in FIG. 6.

In the alternative embodiment of FIG. 6, an elongated tubular shell 40 has one end 42 which is partially closed and there are successive differences in wall thickness to define an interior shaped to form a series of cylindrical seats 44, 46 and 48 each of respective diameters as to frictionally receive an end portion of a corresponding cigarette. Again, and in this case as an extension of seat 48, there also is a tubular wall 50 of predetermined cross-section and which is partially closed at its inner end 52 by a transverse wall that defines a central aperture 54. An air inlet 56 extends through outer wall 40 of the shell.

As in the embodiment of FIG. 1, filter element 30 is composed of a porous material. It has a form which includes elongated hollow sleeve 32 one end 34 of which is closed and the other end 36 of which is open. Encircling the latter is laterally projecting shoulder 38 of a predetermined cross section to seat frictionally within a tubular wall, in this case tubular wall 50, so as also to seat against transverse wall 52 and allow the sleeve to project through aperture 54.

As will be observed, the very same filter element 30 may be utilized in each of the overall filters of FIGS. 1 and 6. It is contemplated that element 30 also may be utilized in other filter-holding structures and even in other smoking apparatus such as pipes. In the particular structure of FIG. 1, the cylindrical seats for the reception of the cigarette face the in-turned structural end of the shell. Also as shown in FIG. 1, the end of shell 12 opposite its in-turned end is partially closed so as to define an outlet openings 57. Moreover, element 30 as shown is formed to include a longitudinally-extending abutment 58 that may engage the margin of outlet opening 57 and is so shaped as to define flow passages in communication through opening 57. In an alternative version, abutment 58 is omitted.

Figure 2:
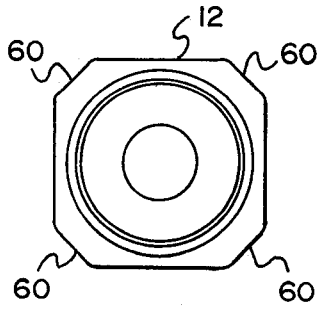
FIG. 2 is an end elevational view taken from the left in FIG. 1.

As further shown in FIG. 2, shell 12 is generally of rectangular cross section but preferably has its four corners 60 depressed inwardly either as a flat as illustrated or alternatively with a curved surface. In FIG. 6, on the other hand, it will be observed that shell 40 is in a form which exhibits a smooth cylindrical exterior; however, a rim 62 outwardly projects from its forward end.

Figure 3:
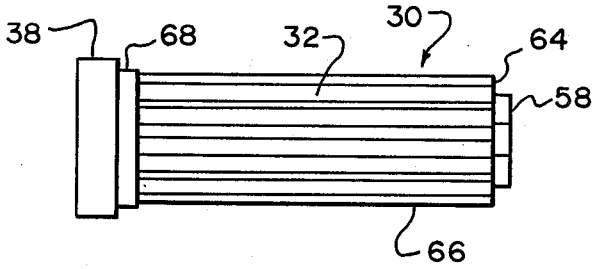
FIG. 3 is a side elevational view of a filter element included within the apparatus of FIG. 1.
Figure 4:
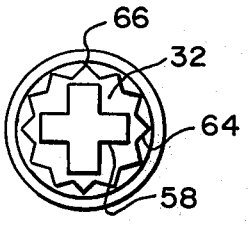
FIG. 4 is an end elevational view taken from the right in FIG. 3.
Figure 5:
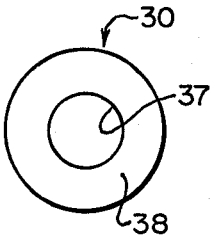
FIG. 5 is an end elevational view taken from the left in FIG. 3.

In either case as herein embodied, element 30 includes externally a series of circumferentially-spaced longitudinal flutes 64. The major diameter or lands 66 of flutes 64 is slightly smaller than the interior of tubular shell 40 in FIG. 6 or within opening 26 in FIG. 1 which, in effect, constitutes a portion of the interior of tubular shell 12. As shown in FIG. 3, a laterally projecting rib 68 may be included at the upstream end of flutes 64 for engagement with the interior of tubular shell 40, in the embodiment of FIG. 6, at a point such that air inlet 56 is located downsteam of rib 68. Alternately, air inlet 56 can be located upstream of rib 68 and shoulder 38. As specifically shown in FIGS. 1 and 6, moreover, rib 68 may be omitted and the flutes extended to shoulder 38. An air passage 79, as shown in FIG. 6, can be incorporated to bypass the porous filter, resulting in lower draw resistance and decreased removal of tar and nicotine. This feature permits an additional degree of flexibility in the overall design.

Figure 8:
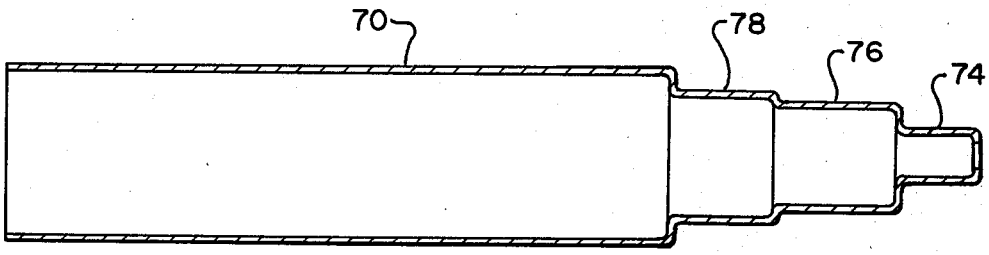
FIG. 8 is a longitudinal cross-sectional view of a component desirably included in the overall assembly.
Figure 9:
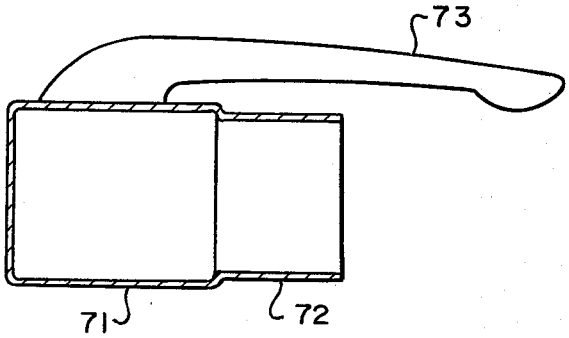
FIG. 9 is a similar view of a related component.

Preferably included in combination with either of the embodiments specifically disclosed is an elongated hollow housing 70 as shown in FIG. 8. Housing 70 is of a cross-sectional area such as to be receptive for storage of shell 12 or shell 40 as the case might be. Associated with housing 70 is a cap 71 necked down at one end 72 so as to be frictionally received within housing 70. Preferably included on the exterior of cap 71 is a clip 73 so disposed, in the manner of a writing instrument, as to engage a medium such as a shirt pocket. Included at the other end of housing 70 is a projecting member 74 which extends from that end of housing 70 and is so dimensioned as to be insertable through an open end of one of shells 12 or 40 for the purpose of dislodging the contained filter element 30 and permit its removal. Of course, some other form of tool may be used within the appropriate end opening for the purpose of permitting such disengagement.

Preferably, housing 70 is necked down as at 76 to seat a spare one of filter elements 30. Then, a further limited-diameter region 78 is included to guide the filter element within the shell 12 or 40 during insertion. Housing 70 has a length sufficient to accommodate both the assembly in use and a spare element.

As illustrated in both embodiments, shoulder 38 is formed at the open end of sleeve 32. From the standpoint of both economy and flexibility of ultimate utility with various receiving structures, this is contemplated to be the most economical overall approach. Nevertheless, shoulder 38 may be located on sleeve 32 at an intermediate position or even at the other end, providing that the receiving shell assembly is appropriately restructured, In any case, the filtering process involves the drawing of the smoke into a hollow passage from which it must exit by flow through walls of the porous filter element.

In accordance with the approach preferred for the formation of filter element 30, the material of which it is composed is a plastic. Element 30 preferably is formed by injecting a powder of that plastic into a mold within which the material is subjected to heat for a period of time sufficient to coalesce the powder into the shape of element 30 while at the same time developing the required limited porosity therein to the flow of the smoke. A filter formed in this manner preferably is initially of a light color but becomes increasingly darker upon the collection within the filter of tar, nicotine or other smoke-contained components during usage of the filter. A suitable powdered plastic useful for this implementation is formula number GUR 413 as supplied by American Hoechst Corporation of Sommerville, N.J. and sold under the trademark "HOSTALEN". Its basic ingredient is an ultra-high-molecular-weight polyethylene, and it initially has been milled or otherwise formed to have a particle size of about 100 microns. It is injected under air pressure sufficient to fill a mold shaped internally to define the filter element as shown in the various figures, during which the mold need only be heated to a temperature of 250° Fahrenheit for a period of fifteen seconds to allow for the making of the ultimate filter element as described. The mold then is cooled for thirty seconds to 210° Fahrenheit after which the filter element is ejected. Whatever the molding technique, it is preferred that the hollow sleeve of the filter exhibit a pore size of between eighteen and twenty-four microns. However, pore size is adjustable as one of the variables in determining ultimate draw resistance and degree of particulate removal. Ideally, shoulder 38 is compacted to a greater density.

In general, the required molding apparatus is of a character in which the components themselves are state of the art in the field of injection molding. One suitable specific approach is described in copending application Ser. No. 055,637 filed July 9,1979, under the title "Method and Apparatus for Producing Porous Shaped Products" and assigned to the same assignee as the present application. As specifically adapted to the molding of the smoking filters herein described, the mold base is divided into two halves. In the top half, there is a spacer plate which maintains the proper distance between other parts in the mold base, and a core pin plate which properly locates a plurality of core pins. A core pin shoulder plate maintains the proper distance for establishing proper head size and length of the ultimate filter element. A cavity plate contains a plurality of cavities distributed in appropriate locations. An operating lever together with a retaining plate therefor affords operational control in selection between injection, curing and ejection. Ejection/injection pins provide a facility both for the ejection of parts and the injection of the powder, with those pins being mounted upon a suitably located plate. Next in order within the top half of the mold is an injection plate which provides a path for the material to reach the injection pins. The bottom half of the mold base includes a compaction spacer with establishes the proper distance for compaction of material and another ejection spacer which establishes the proper distance between the core pins and the cavity plate so that ejection of the parts may occur during operation.

The particular arrangement allows for air injection of the powder and the mechanical ejection of the molded part. In one successful version, there were six element cavities. Carried on the cavity plate was a band-type heater, and a pair of cartridge heaters is carried upon the core pin plate. The material was supplied from a reservoir into which air was admitted under pressure to cause the powder to flow from the reservoir into the injection plate. Another supply of air was introducable directly into the cavity plate for the purpose of cooling.

In operation, all heaters or heating elements were set to reach a temperature of 360° Fahrenheit. The heating time was fifteen seconds and the subsequent air cooling time was thirty seconds with the heaters continuing to be energized. Operation was begun by energizing the heaters and, after they had obtained the set temperature, allowing approximately five minutes for the establishment of uniformity and stability of heating effect throughout all plates in the mold assembly. The top half of the mold base was then moved down until the core pin shoulders just entered the cavities. The compacting spacer was, at this point, inserted between the core pin shoulder plate and the cavity plate. The top half of the mold base was then brought down to meet with the bottom half and the air was inletted so as to fill the cavities with the powder. The top half was then released just enough to remove the compacting spacer. Once again, the top mold half was brought downwardly and forced against the bottom mold half so as to compact the material within the cavities. Thereafter, the top mold half was raised a small distance, perhaps five-/eighths inch, and the material was permitted to "cook" for fifteen seconds. Immediately at the end of the latter time period, ambient-temperature cooling air was inserted into the cavity and the top half was raised away another slight distance of about one/half inch; cooling was allowed for about thirty seconds. Thereafter, the top half was pulled fully away from the bottom half and the ejection spacer was inserted. Bringing the top half once more all the way down caused ejection of the completed filter elements. Once more fully raising the top half and removing the ejection spacer permitted withdrawal of the parts by vacuum.

One benefit of air injection of the raw powder in the mold is the avoidance of contamination as well as the achievement of constant uniform distribution of any flavoring agents that have been introduced. At the same time, compaction in particular areas, such as in the area of shoulder 38, is such as to achieve an increase in density in that particular region. Positive ejection enables complete automation of the process and the result of a constant size and shape of the ultimate filter secured by curing right in the cavity. Related to this, the cooling of the filter element in the cavity not only allows for proper ejection but also eliminates loose particles and runners. The rotatable operating lever aligns each appropriately sized hole with the cavity for injection of the raw material, enables closing of the inlet hole to the cavity in order to achieve compaction and also aligns a properly sized hole with the cavity for the purpose of ejection of the finished part. As indicated, all operations are completely automated; this is achieved through the use of appropriate solenoids, microswitches and thermocouples. Desirably, the unit also includes an appropriate counter.

Another aspect of the formation of the filter is the introduction thereinto of a flavoring agent. That may be accomplished by introducing such an agent into the original powder before the filter is molded or by immersing the completed filter element into a solution which contains the flavoring agent. In one particular approach which has proved to be successful, freeze-dried, powdered flavoring agents are mixed mechanically with the powdered polyethylene prior to molding as described above. Three flavors have been successfully used, including natural and artificial cigarette flavors and natural menthol flavors. Concentrations of one to five percent have been satisfactory. The flavoring easily mixes with the polyethylene. With this approach, the flavor is not lost in the molding process. Moreover, the flavoring material is so bonded during the molding of the part that it does not separate from the body of the filter under normal usage. It has been found that the flavor exists for at least twenty cigarettes.

In the approach presented for either specific version of the holder, the design is consistent with that taught in the aforementioned application Ser. No. 828,505 for the purpose of assigning a specific draw resistance or for correlating draw resistances as between different filter units in a withdrawal kit. To increase smoke removal and reduce draw resistance, for example, the size of air inlet hole 28 or 56 is increased. Draw resistance and smoke removal may be increased by increasing the internal resistance to smoke flow. Impedance to smoke flow is adjustable by variation in either the internal wall area and thickness of element 30 or the pore size therein, or both. Those variables, in turn, may be correlated with the size of the air inlet to determine the net draw resistance. As indicated above, however, air inlet hole 56 can be positioned downstream of filter 30 or upstream within diameter 48 to achieve different draw and removal characteristics as may be desired. Air passage 79 represents an alternative configuration that allows some unfiltered smoke to bypass the porous filter, resulting in decreased reduction of tar and nicotine.

The foregoing disclosed smoking filters serve to reduce harmful components in smoke, while yet allowing the user to continue with what would amount to normal smoking habits, or they may be components of withdrawal kits. The amount of original smoke inhaled is subject to a reduction of its contaminates by means of internal collection as well as its dilution with ambient air. At the same time, the design of the apparatus may be such as to maintain at least more or less normal draw resistance, so that the user is enabled to employ the filter without substantial departure from whatever physiological or psychological effect he is accustomed to as a result of puffing on the cigarette or apparatus. The manner of approach retains such known advantages as providing a visual indication of particle collection as well as enabling the user to receive an indication of a need for replacement of the internal filter element by reason of increased draw resistance.

The entire apparatus involves an approach which need only require two-piece construction, and only one of those pieces needs to be replaced from time to time. As indicated above, the size of the ambient-air inlet aperture may be adjusted with regard to the pore size, and hence the draw resistance imposed by the filter element may be adjusted, so as to allow the user to accommodate normal smoking habits. The introduction of flavoring may vary widely as to taste. In any event, the general purpose of flavoring is to put something back into the smoke as received by the user to accommodate the fact that good filtering serves to remove original taste.

The present approach also has the inherent advantage in overall structure that the nature of the filter element itself, as the initial trapping medium, tends to preclude any build-up of deposits within the holder apart from the element. At the same time, however, the use of a flavoring agent tends to minimize any resultant emission of odors from the filter element even when not in use.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A smoking filter comprising:

an elongated tubular shell one interior end portion of which is shaped to define a coupling to a smoking device and longitudinally of said coupling being shaped to define a tubular wall of predetermined cross-section;

means defining an air inlet through the outer wall of said shell;

a filter element, of a rigidified porous plastic material inhibitive to the passage of substances in said smoke and in the form of an elongated hollow sleeve one integral and commonly-formed end of which is closed and the other end of which is open; means supporting said filter element within said tubular shell beyond said coupling.

2. A filter as defined in claim 1 in which said one end portion of said shell is turned re-entrantly inward and shaped to define a seat to receive frictionally an end portion of a smoking device.

3. A filter as defined in claim 2 in which said seat faces said one end of said tubular shell.

4. A filter as defined in claim 1 in which said one end of said tubular shell is formed to define a laterally-projecting rim.

5. A filter as defined in claim 1 in which the other end of said tubular shell is partially closed to define an outlet opening having a margin therearound.

6. A filter as defined in claim 5 in which said element is disposed with its one end in facing relationship with said outlet opening and in which said element includes a longitudinally-extending abutment, projecting away from said sleeve, engageable with the margin of said outlet opening and defining flow passages in communication through said opening.

7. A filter as defined in claim 1 in which said element includes externally a series of circumferentially-spaced longitudinal flutes.

8. A filter as defined in claim 7 in which the lands between said flutes have a diameter slightly less than the interior of said tubular shell to allow smoke and air passage between the flutes and the interior of said tubular shell.

9. A filter as defined in claim 7 in which said element includes a laterally projecting rib at the upstream end of said flutes that is engageable with the interior of said tubular shell, and in which said air inlet is located downstream of said rib.

10. A filter as defined in claim 1 and further comprising:

said element including externally a series of circumferentially spaced longitudinal flutes;

said element including a laterally-projecting rib at the upstream end of said flutes that is engageable with the interior of said tubular shell, said air inlet being located downstream of said ribs;

and said air inlet being located upstream of said rib.

11. A filter as defined in claim 1 which further includes an elongated hollow housing receptive of said tubular shell for storage therein.

12. A filter as defined in claim 11 in which said housing includes a clip externally mounted thereon and disposed to engage a medium disposed between the exterior of said housing and said clip.

13. A filter as defined in claim 11 in which said housing includes a member, projecting longitudinally outward therefrom and of a diameter to be insertable through an end of said tubular shell to dislodge said filter element from said tubular shell.

14. A filter as defined in claim 11 in which said housing includes a barrel receptive of said smoking filter for storage and a removable cap for closing said barrel.

15. A filter as defined in claim 11 in which said housing is of a length sufficient to store, in addition to said smoking filter, an additional one of said filter elements.

16. A filter as defined in claim 1 in which said shell is generally of rectangular cross-section but with its corners depressed inwardly.

17. A filter as defined in claim 1 in which said material initially is of a light color subject to becoming increasingly darker upon collection therein of said substances during usage.

18. A filter as defined in claim 1 in which said other end of said tubular shell defines and outlet opening and in which said one end of said filter element is aligned with said opening to permit disengagement of said filter element from said tubular wall by means of a tool inserted through said opening.

19. A filter as defined in claim 1 in which said material of said element is a plastic and in which said element is formed by injecting a powder of said material into a mold and subjected to heat for a period of time sufficient to coalesce said powder into the shape of said element while developing limited porosity therein to the flow of said smoke.

20. A filter as defined in claim 1 in which said other end of said tubular shell defines an outlet opening, and which further comprises means, including a contour defined in said tubular wall, defining a passage between said coupling and said outlet opening in bypass of said filter element.

21. A smoking filter comprising:

an elongated tubular shell one interior end portion of which is shaped to define a coupling to a smoking device and longitudinally of said coupling being shaped to define a tubular wall of predetermined cross-section;

means defining an air inlet through the outer wall of said shell;

a filter element, of a porous material inhibitive to the passage of substances in said smoke and in the form of an elongated hollow sleeve one end of which is closed and the other end of which is open, disposed within said tubular shell beyond said coupling;

said tubular wall being partially closed by a transverse wall in which is defined a central aperture;

means on the exterior of said sleeve defining a laterally projecting shoulder of a cross-section to seat within said tubular wall and against said transverse wall with a portion of said sleeve projecting through said aperture;

and said shoulder being of a size to seat frictionally within said tubular wall.

22. A smoking filter comprising:

an elongated tubular shell one interior end portion of which is shaped to define a coupling to a smoking device and longitudinally of said coupling being shaped to define a tubular wall of predetermined cross-section;

means defining an air inlet through the outer wall of said shell;

a filter element, of a porous material inhibitive to the passage of substances in said smoke and in the form of an elongated hollow sleeve one end of which is closed and the other end of which is open, disposed within said tubular shell beyond said coupling;

said tubular wall being partially closed by a transverse wall in which is defined a central aperture;

means on the exterior of said sleeve defining a laterally projecting shoulder of a cross-section to seat within said tubular wall and against said transverse wall with a portion of said sleeve projecting through said aperture;

and the interior lateral dimension of said tubular shell being changed in successive steps to define said coupling and to define a seat for said shoulder.

23. A filter as defined in claim 22 in which the thickness of said tubular shell is changed correspondingly to establish said steps.

24. A smoking filter comprising:

an elongated tubular shell one interior end portion of which is shaped to define a coupling to a smoking device and longitudinally of said coupling being shaped to define a tubular wall of predetermined cross-section;

means defining an air inlet through the outer wall of said shell;

a filter element, of a porous material inhibitive to the passage of substances in said smoke and in the form of an elongated hollow sleeve one end of which is closed and the other end of which is open, disposed within said tubular shell beyond said coupling;

said tubular wall being partially closed by a transverse wall in which is defined a central aperture;

means on the exterior of said sleeve defining a laterally projecting shoulder of a cross-section to seat within said tubular wall and against said transverse wall with a portion of said sleeve projecting through said aperture;

and said shoulder being effectively located in a position encircling said other end of said sleeve.

25. A smoking filter comprising:

an elongated tubular shell one interior end portion of which is shaped to define a coupling to a smoking device and longitudinally of said coupling being shaped to define a tubular wall of predetermined cross-section;

means defining an air inlet through the outer wall of said shell;

a filter element, of a porous material inhibitive to the passage of substances in said smoke and in the form of an elongated hollow sleeve one end of which is closed and the other end of which is open, disposed within said tubular shell beyond said coupling;

said tubular wall being partially closed by a transverse wall in which is defined a central aperture;

means on the exterior of said sleeve defining a laterally projecting shoulder of a cross-section to seat within said tubular wall and against said transverse wall with a portion of said sleeve projecting through said aperture;

and said air inlet being effectively located downstream of said shoulder.

26. A smoking filter comprising:

an elongated tubular shell one interior end portion of which is shaped to define a coupling to a smoking device and longitudinally of said coupling being shaped to define a tubular wall of predetermined cross-section;

means defining an air inlet through the outer wall of said shell;

a filter element, of a porous material inhibitive to the passage of substances in said smoke and in the form of an elongated hollow sleeve one end of which is closed and the other end of which is open, disposed within said tubular shell beyond said coupling;

means on the exterior of said sleeve defining a laterally projecting shoulder of a cross-section selected to seat within said tubular wall;

the material of said element being molded from a powder;

and said shoulder being compacted during molding to a density greater than that of said sleeve.

27. A smoking filter comprising:

an elongated tubular shell one interior end portin of which is shaped to define a coupling to a smoking device and longitudinally of said coupling being shaped to define a tubular wall of predetermined cross-section;

means defining an air inlet through the outer wall of said shell;

a filter element, of a porous material inhibitive to the passage of substances in said smoke and in the form of an elongated hollow sleeve one end of which is closed and the other end of which is open, disposed within said tubular shell beyond said coupling;

said tubular wall being partially closed by a transverse wall in which is defined a central aperture;

and means on the exterior of said sleeve defining a laterally projecting shoulder of a cross-section to seat within said tubular wall and against said transverse wall with a portion of said sleeve projecting through said aperture.

28. A filter as defined in claim 27 in which said sleeve includes externally a series of circumferentially-spaced longitudinal flutes.

* * * * *